US006905381B2

(12) United States Patent
Araki et al.

(10) Patent No.: US 6,905,381 B2
(45) Date of Patent: Jun. 14, 2005

(54) SMALL WATERCRAFT AND ACTUATOR FOR SMALL WATERCRAFT

(75) Inventors: Toshio Araki, Kakogawa (JP); Atsufumi Ozaki, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 94 days.

(21) Appl. No.: 10/659,555

(22) Filed: Sep. 9, 2003

(65) Prior Publication Data

US 2004/0082232 A1 Apr. 29, 2004

(30) Foreign Application Priority Data

Sep. 9, 2002 (JP) ..... 2002-262766

(51) Int. Cl.[7] ..... B63H 11/107
(52) U.S. Cl. ..... 440/40; 440/84
(58) Field of Search ..... 440/38, 40, 41, 440/84

(56) References Cited

U.S. PATENT DOCUMENTS 5,507,672 A * 4/1996 Imaeda ..... 440/1
6,350,163 B1 * 2/2002 Fujimoto ..... 440/1

FOREIGN PATENT DOCUMENTS

| | | |
|---|---|---|
| JP | 2001-191992 | 7/2001 |
| JP | 2002-303170 | 10/2002 |

* cited by examiner

*Primary Examiner*—Jesus D. Sotelo
(74) *Attorney, Agent, or Firm*—Alleman Hall McCoy Russell & Tuttle LLP

(57) ABSTRACT

A jet-propulsion small watercraft, comprises a water jet pump that pressurizes and accelerates water taken in from outside and ejects the water to propel the watercraft, a steering system configured to steer the watercraft by changing an ejection direction of the water, a steering throttle arm configured to cause a throttle valve of an engine to open, thereby maintaining a steering capability, in response to a closing operation of a throttle lever, an actuator configured to cause the throttle valve in a closed position to open by steering throttle arm, and a spring configured to return the throttle valve to the closed position, wherein the actuator includes a motor configured to be energized at a predetermined motor power value by control of a control device, a reduction mechanism configured to reduce a speed of the motor, and an output shaft configured to be rotated by the reduction mechanism.

14 Claims, 8 Drawing Sheets

SMALL WATERCRAFT AND ACTUATOR FOR SMALL WATERCRAFT

BACKGROUND OF THE INVENTION

1. Field of the Invention

The present invention relates to a jet-propulsion small watercraft such as a personal watercraft (PWC) which ejects water rearward and planes on a water surface as the resulting reaction. More particularly, the present invention relates both to a small watercraft comprising an actuator for driving a steering throttle drive means configured to open a propulsion throttle valve a predetermined angle under a predetermined condition, thereby maintaining a steering capability, when the throttle valve is operated to be closed, and to the actuator.

2. Description of the Related Art

In recent years, jet-propulsion personal watercraft, which are one type of jet-propulsion small watercraft, have been widely used in leisure, sport, rescue activities, and the like. The jet-propulsion personal watercraft is configured to have a water jet pump that pressurizes and accelerates water sucked from a water intake generally provided on a bottom hull surface and ejects it rearward from an outlet port. Thereby, the personal watercraft is propelled.

In the jet-propulsion personal watercraft, a steering nozzle provided behind the outlet port of the water jet pump is swung either to the right or to the left, to change the ejection direction of the water to the right or to the left, thereby turning the watercraft to the right or to the left.

In the jet-propulsion personal watercraft, when the throttle valve is moved to a substantially fully closed position and the water ejected from the water jet pump is thereby reduced, the propulsion force necessary for turning (steering) the watercraft is correspondingly reduced, and the steering capability of the watercraft is therefore reduced until the throttle valve is re-opened.

To solve the above problem with a mechanical structure, the applicant disclosed a jet-propulsion watercraft comprising a steering component for a steering system which is capable of maintaining a steering capability even when the throttle valve is moved to the substantially fully closed position and the water ejected from the water jet pump is thereby reduced (Japanese Laid-Open Patent Application Publication No. Hei. 2001-191992).

In the jet-propulsion watercraft, the number of components is large, so that its structure becomes complex and its weight increases. In view of this, the applicant also disclosed a jet-propulsion watercraft that has a simple structure without an increase in its weight (Japanese Laid-Open Patent Application Publication No. Hei. 2002-303170).

SUMMARY OF THE INVENTION

The present invention addresses the above described condition, and an object of the present invention is to provide a small watercraft including a personal watercraft, comprising an actuator suitable for a jet-propulsion watercraft capable of maintaining a steering capability even when a throttle valve is moved to a substantially fully closed position and water ejected from a water jet pump is thereby reduced. Another object of the present invention is to provide an actuator suitable for the small watercraft.

According to the present invention, there is provided a jet-propulsion small watercraft, comprising a water jet pump that pressurizes and accelerates water taken in from outside and ejects the water from an outlet port provided behind the water jet pump to propel the watercraft as a reaction of the ejecting water, a steering means configured to steer the watercraft by changing an ejection direction of the water ejected from the outlet port, a throttle operation means configured to operate a throttle valve of an engine, a steering throttle drive means configured to cause the throttle valve of the engine to open a predetermined angle under a predetermined condition, thereby maintaining a steering capability, in response to a closing operation of the throttle operation means, an actuator configured to cause the throttle valve of the engine in a closed position to open a predetermined angle by the steering throttle drive means, and a spring configured to return the throttle valve of the engine to the closed position, wherein the actuator includes a motor configured to be energized at a predetermined current value by control of a control device, a reduction mechanism configured to reduce a speed of the motor, and an output shaft configured to be rotated at a reduced speed by the reduction mechanism, and when energizing the actuator is stopped by the control of the control device, the actuator permits the throttle valve of the engine to return to the closed position by a spring force of the spring.

In accordance with the jet-propulsion small watercraft so configured, when the throttle operation means, for example, a throttle lever, is operated to be closed, and the steering means is operated to the predetermined angle or more, the control device causes the motor of the actuator to be energized at a predetermined current value. Thereby, the motor of the actuator rotates to cause the output shaft to rotate at the reduced speed, and the steering throttle drive means is operated to cause the throttle valve of the engine to open the predetermined angle. Thus, under the condition in which the throttle valve of the engine is at the closed position, the steering function is performed by operation of the steering. When the small watercraft arrives at a shore or a pier by such steering and an electric power supply switch of the small watercraft is turned OFF by the rider, the power of the motor is cut off. As a result, the actuator permits the propulsion throttle valve to return to a closed position by the spring force. And, when the rider turns ON the switch of the small watercraft, the actuator is in a non-energized state, that is, the steering throttle drive means is not operated, and hence, the throttle valve of the engine is in an idling state. Therefore, when turning ON the switch, the rider need not reset the steering throttle drive means, i.e., the actuator. As should be appreciated, the jet-propulsion watercraft capable of maintaining a steering capability when the throttle valve is in the closed position is achieved by incorporating the actuator suitable for the watercraft.

The steering throttle drive means may be a steering throttle arm attached on a throttle operation shaft of the engine, the steering throttle arm being configured to be rotatable integrally with the throttle operation shaft only in a direction to rotate for increasing an engine speed of the engine and not to be rotatable integrally with the throttle operation shaft in an opposite direction.

The throttle operation shaft may be provided with a propulsion throttle arm capable of operating the throttle valve by an operation of the throttle operation means.

The propulsion throttle arm may be attached on the throttle operation shaft to be rotatable integrally with the throttle operation shaft only in a direction to rotate for increasing the engine speed and not to be rotatable integrally with the throttle operation shaft in an opposite direction.

The steering throttle arm and the propulsion throttle arm may be configured to operate the throttle operation shaft and operate independently of each other so that an operation of one of the steering throttle arm and the propulsion throttle arm does not affect an operation of the other.

A reel member may be attached on the output shaft of the actuator to be rotatable integrally with the output shaft, an end of a wire is attached to the reel member, and an opposite end of the wire is attached to the steering throttle arm.

The motor may be a servo motor, and the small watercraft may further comprise a stopper configured to stop the steering throttle drive means at a position where the throttle valve of the engine is opened the predetermined angle, to inhibit further operation from the position, and the control device may be configured to control power input to the servo motor to reduce an output value of the servo motor, upon detecting variation in the current being supplied to the servo motor when the steering throttle drive means makes contact with the stopper. In this configuration, after the throttle valve of the engine is operated to be opened a predetermined angle, the amount of current necessary to maintain the condition is minimized. Therefore, power consumption in the battery is significantly reduced.

When the steering throttle drive means makes contact with the stopper, the control device may be configured to execute control to cause the value of the power of the servo motor to be reduced to substantially 30% of the value of the power of the servo motor in a state in which the steering throttle drive means is not in contact with the stopper. In this configuration, the power consumption in the battery can be significantly reduced.

The reduction mechanism may comprise a gear train comprised of pinion and large gears having different number of teeth, and the actuator is covered by a water-proof cover, wherein a shaft on which at least one of the gears is attached is supported by a bearing attached to a water-proof cover. The actuator having the reduction mechanism can be easily placed within an engine room of the small watercraft.

The spring may be a helical torsion spring provided on a throttle operation shaft.

According to the present invention, there is provided an actuator for use as a drive source of a movable portion of the small watercraft, comprising: a motor for driving an output shaft of the actuator, a reduction mechanism configured to reduce a speed from the motor and transmit the reduced speed toward the output shaft, a control means configured to control a value of the power of the motor, and a water-proof cover configured to expose an output portion of the output shaft and cover at least the motor, the reduction mechanism, and part of the output shaft.

The actuator configured as described above is water proof and compact. In addition, the actuator includes the control means configured to control the value of the power of the motor. Such an actuator is useful as the operation means for components in a small watercraft having little water-proof space, especially in a small watercraft used in an atmosphere filled with water spray or water drops. The operation means may be used to open and to close the throttle valve of an engine, or to open and to close an exhaust pipe (exhaust passage). That is, the actuator is suitable for use in the small watercraft of the present invention.

The motor may be a servo motor, and the actuator may further comprise a stopper configured to stop the output shaft at a position where the output shaft rotates a predetermined angle so as to inhibit further rotation from the position, and the control device may be configured to control a value of a power of the servo motor to reduce an output value of the servo motor, upon detecting variation in the current being supplied to the servo motor when the output shaft makes contact with the stopper. In this configuration, after the output shaft rotates the predetermined angle, the amount of current necessary to maintain the condition is minimized. Therefore, the power consumption in the battery can be reduced.

When the output shaft makes contact with the stopper, the control device may be configured to execute control to cause the value of the power of the servo motor to be reduced to substantially 30% of the value of the power of the servo motor in a state in which the output shaft is not in contact with the stopper.

The reduction mechanism may comprise a gear train comprised of pinion and large gears having different number of teeth, and a shaft on which at least one of the gears is attached, supported by a bearing attached to the water-proof cover.

The above and further objects and features of the invention will more fully be apparent from the following detailed description with the accompanying drawings.

DETAILED DESCRIPTION OF THE PREFERRED EMBODIMENTS

Hereinafter, an embodiment of a jet-propulsion small watercraft of the present invention will be described with reference to the drawings. Here, a personal watercraft will be described.

Figure 7:
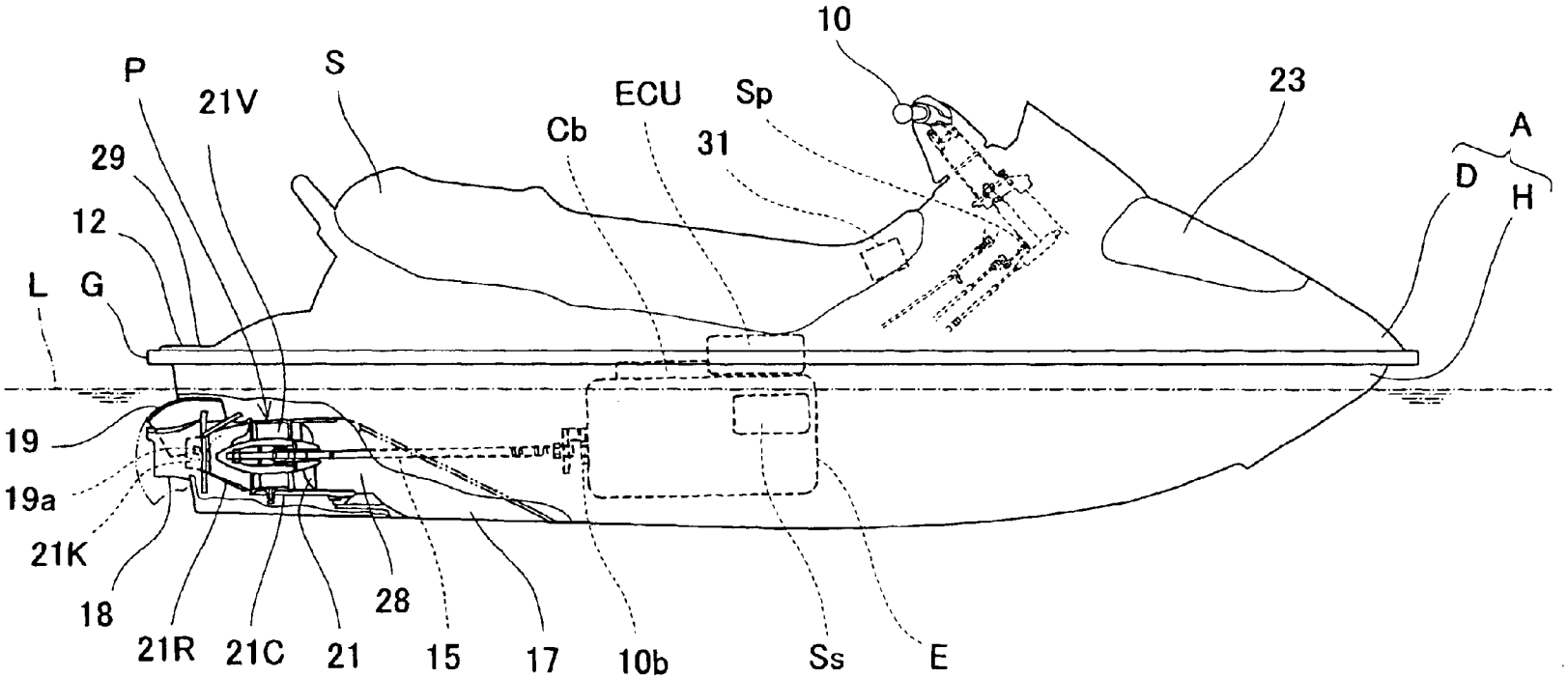
FIG. 7 is a side view of the personal watercraft according to the embodiment of the present invention.
Figure 8:
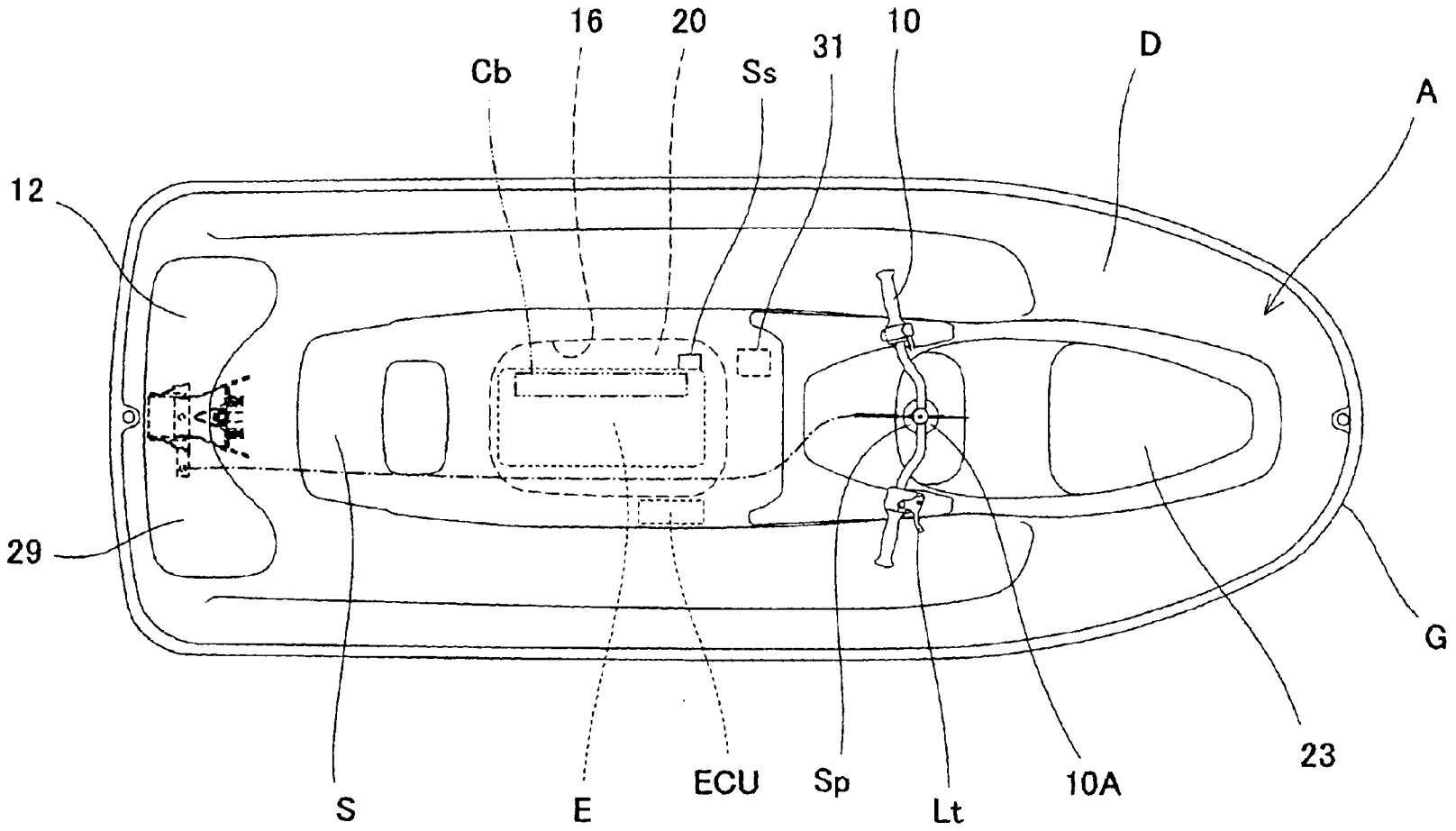
FIG. 8 is a plan view of the personal watercraft in FIG. 7.

Referring now to FIGS. 7 and 8, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 8, an opening 16, which has a substantially rectangular shape seen from above, is formed at a relatively rear section of the deck D such that it extends in the longitudinal direction of the body A, and a straddle-type seat S is mounted above the opening 16 such that it covers the opening 16 from above as shown in FIGS. 7 and 8.

An engine E is contained in a chamber 20 surrounded by the hull H and the deck D below the seat S and having a convex shape in a cross section of the body A. The engine E is a multiple-cylinder (e.g., three cylinder) engine equipped with a carburetor-type fuel supply device. As shown in FIG. 7, the engine E is mounted such that a crankshaft 10*b* extends along the longitudinal direction of the body A.

An output end of the crankshaft 10*b* is rotatably coupled integrally with a pump shaft 21S of the water jet pump P through a propeller shaft 15.

The impeller 21 is covered with a pump casing 21C on the outer periphery thereof. A water intake 17 is provided on the bottom of the hull H. The water is sucked from the water intake 17 and fed to the water jet pump P through a water intake passage 28. The water jet pump P pressurizes and accelerates the water. The pressurized and accelerated water is discharged through a pump nozzle 21R having a cross-sectional area of flow that gradually reduces rearward, and from an outlet port 21K provided on the rear end of the pump nozzle 21R, thereby obtaining the propulsion force. In FIG. 7, reference numeral 21V denotes fairing vanes for fairing water flow inside the water jet pump P.

In FIGS. 7 and 8, reference numeral 10 denotes a bar-type steering handle. By operating the steering handle 10 to the right or to the left, a steering nozzle 18 provided behind the pump nozzle 21R swings to the right or to the left The watercraft can be turned to any desired direction while the water jet pump P is generating the propulsion force.

As shown in FIG. 7, a bowl-shaped reverse deflector 19 is provided above the rear side of the steering nozzle 18 such that it can swing downward around a horizontally mounted swinging shaft 19*a*.

The deflector 19 is swung downward toward a lower position behind the steering nozzle 18 to deflect the water ejected from the steering nozzle 18 forward, and as the resulting reaction, the personal watercraft moves rearward.

In FIGS. 7 and 8, reference numeral 12 denotes a rear deck. The rear deck 12 is provided with an operable hatch cover 29. A rear compartment (not shown) with a small capacity is provided under the hatch cover 29. In FIG. 7 or 8, reference numeral 23 denotes a front hatch cover. A front compartment (not shown) is provided under the front hatch cover 23 for storing equipment and the like.

The personal watercraft according to this embodiment of the present invention, as shown in FIGS. 7 and 8, may further include a steering position sensor Sp comprised of a proximity switch having parts which are provided on a rotational side and a fixed side of a portion of a rotational shaft 10A of the steering handle 10. A throttle position sensor Ss is provided on a carburetor Cb (see FIG. 1) of the engine E.

Figure 1:
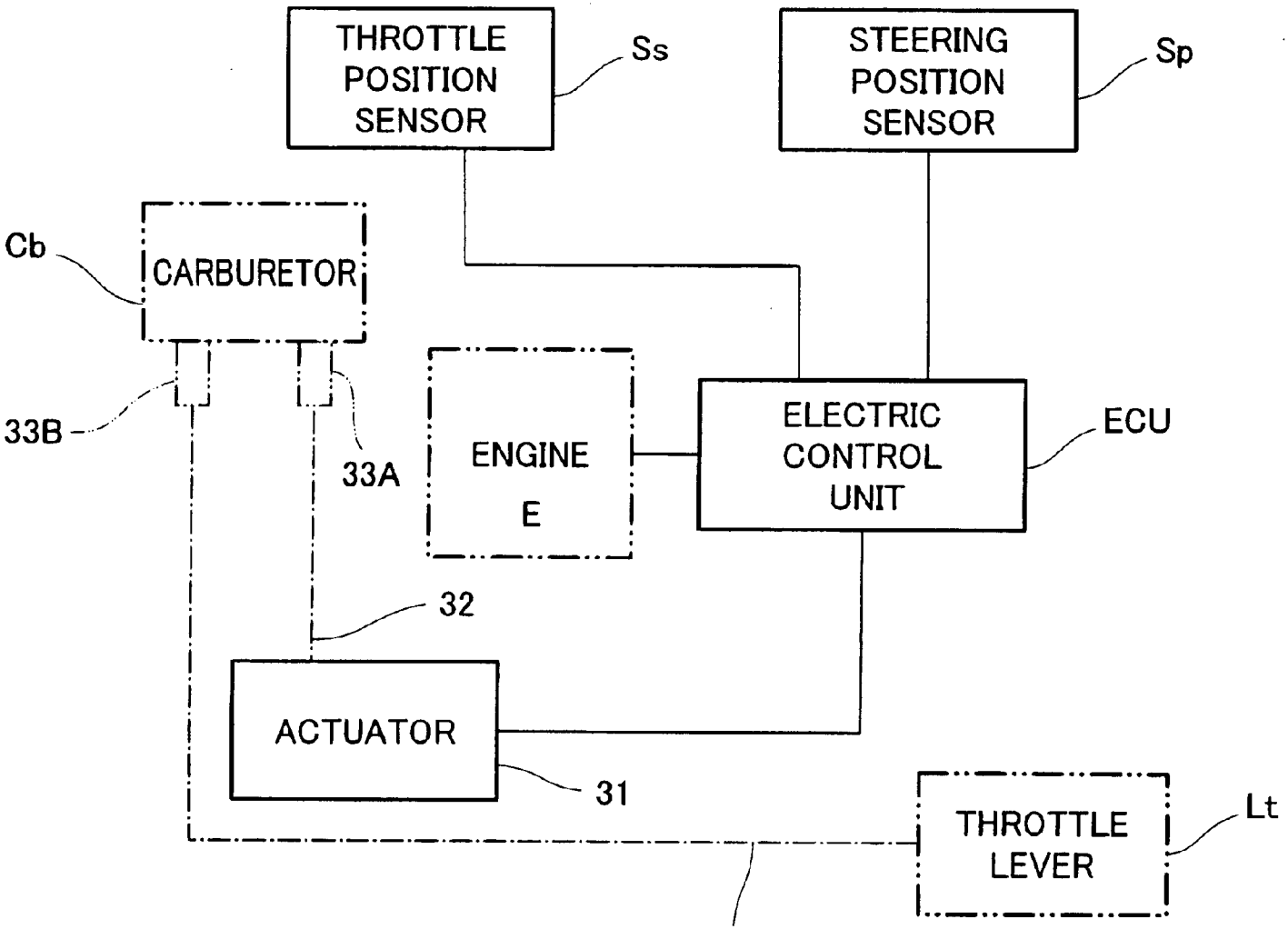
FIG. 1 is a block diagram showing a configuration of a control system of a jet-propulsion personal watercraft according to an embodiment of the present invention.

As represented by a solid line in FIG. 1, the steering position sensor Sp is connected to an electric control unit ECU provided for the engine E through a signal line (e.g., electric wire) and the throttle position sensor Ss is connected to the electric control unit ECU through the signal line. When a steering operation is performed, that is, the steering handle 10 (see FIGS. 7 and 8) is steered a predetermined angle to the right or to the left, the steering position sensor Sp sends a signal indicating that the steering operation has been performed, to the electric control unit ECU.

When the throttle lever Lt attached on the steering handle 10 (see FIG. 8) is operated to be closed to cause the throttle valve of the carburetor Cb to be moved to a closed position, the throttle position sensor Ss is configured to send a signal indicating this to the electric control unit ECU.

As shown in FIG. 1, the electric control unit ECU is connected to the actuator 31, more precisely to a control board 31*c* (see FIG. 4) of the actuator 31 through the signal line and is configured to control an operation of the actuator 31. In this embodiment, upon reception of an operation signal from the electric control unit ECU, the control board 31*c* of the actuator 31 controls power to motor 31*m* of the actuator 31.

Figure 2:
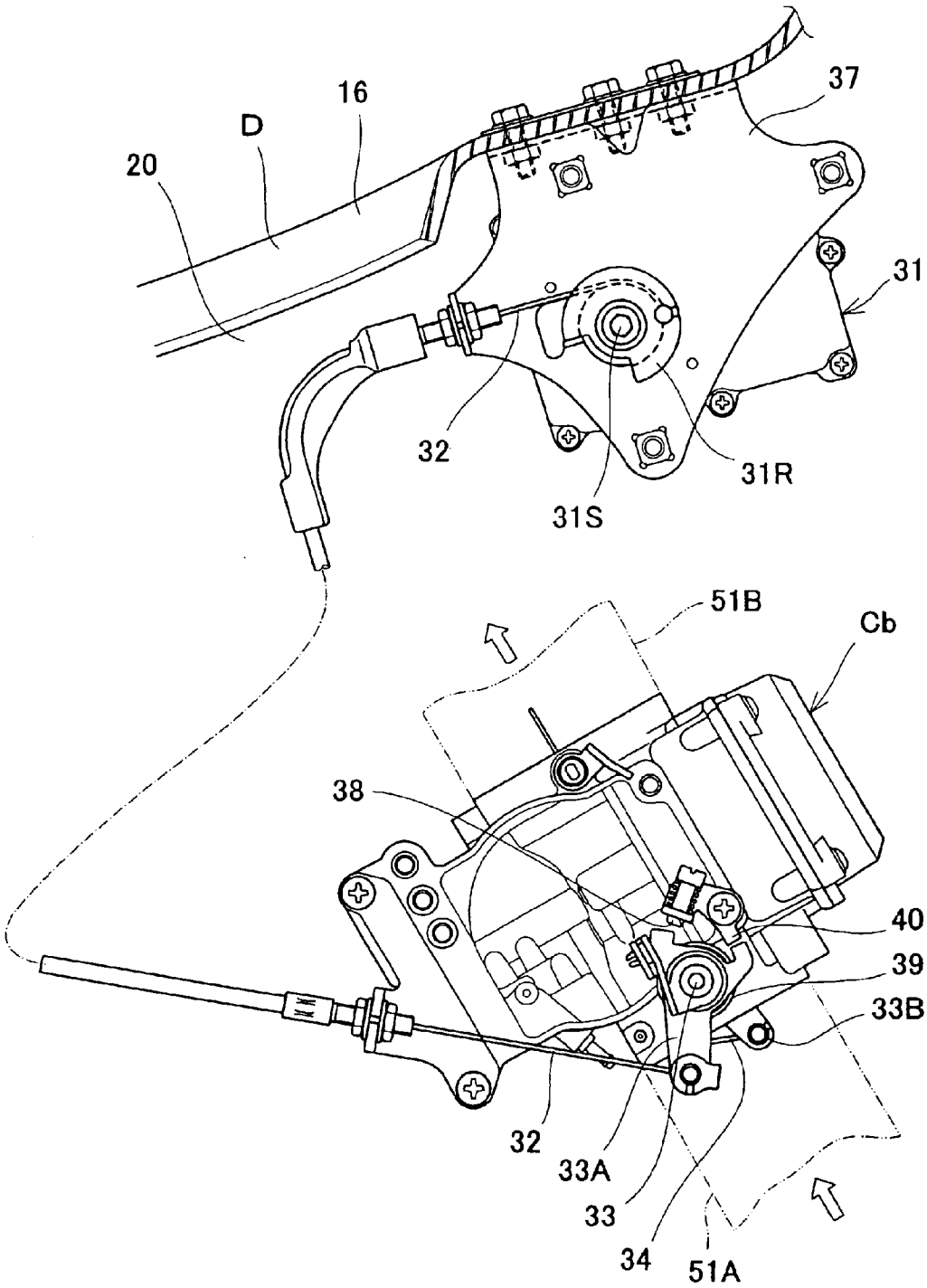
FIG. 2 is a view showing a configuration in which an actuator in FIG. 1 is connected to a carburetor under the condition in which the actuator is in a non-operating state.
Figure 3:
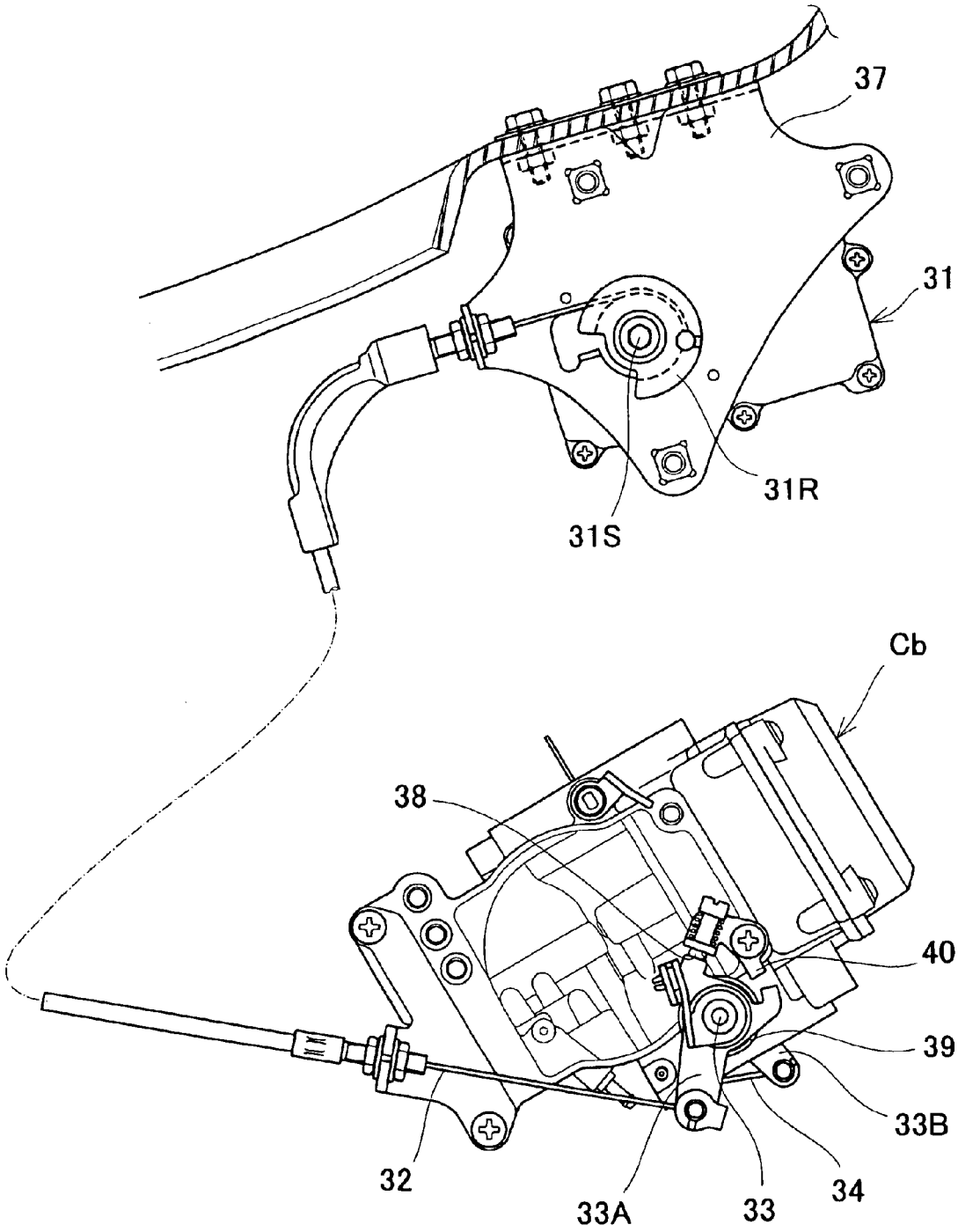
FIG. 3 is view showing a configuration in which the actuator in FIG. 2 is connected to the carburetor under the condition in which the actuator is in an operating state.

As shown in FIG. 2 or 3, a reel member 31R is rotatable integrally with an output shaft 31S of the actuator 31. The reel member 31R is connected to a steering throttle arm (steering throttle drive means) 33A of the carburetor Cb through a wire (or rod) 32. The steering throttle arm 33A is provided to be rotatable integrally with a throttle operation shaft 33 of the carburetor Cb only in one direction (direction in which the throttle arm 33A causes the engine speed to increase, clockwise in FIGS. 2 and 3). The carburetor Cb is provided with a stopper 38 as an upper limiter configured to stop further rotation of the steering throttle arm 33A, i.e., to inhibit the engine speed from exceeding approximately 2000 rpm, in this embodiment. The carburetor Cb is further provided with a stopper 40 as a lower limiter so as to inhibit the engine speed from decreasing to a value not more than an idling speed.

The throttle operation shaft 33 of the carburetor Cb is provided with a helical torsion spring 39 configured to cause the operation shaft 33 to return to an idling position (i.e., rotate counterclockwise in FIGS. 2 and 3 to be brought into contact with the stopper 40), when an external force from the steering throttle arm 33A and an external force from a propulsion throttle arm 33B of the carburetor Cb are not exerted on the operation shaft 33 any more, i.e., the steering throttle arm 33A and the propulsion throttle arm 33B become non-operating states.

As in a general carburetor, a throttle valve (not shown) provided within an air-intake passage of the carburetor Cb to be openable and closable, is attached on the throttle operation shaft 33. By rotating the throttle operation shaft 33, the throttle valve within the air-intake passage is opened and closed, thereby causing the amount of taken-in air flowing within the carburetor Cb to be increased and decreased.

The propulsion throttle arm 33B as the propulsion throttle drive means is provided on the throttle operation shaft 33 of the carburetor Cb to be rotatable integrally with the throttle operation shaft 33 only in one direction (direction in which the throttle arm 33B rotates to cause the engine speed to increase, i.e., clockwise in FIGS. 2 and 3). As represented by a dashed line in FIG. 1, the throttle arm 33B is connected to the throttle lever Lt attached on the handle 10 (see FIG. 8) through a wire 34. Upon the rider operating the throttle lever Lt, the throttle operation shaft 33 of the carburetor Cb rotates by rotation of the throttle arm 33B in FIG. 2, thereby causing the throttle valve within the carburetor Cb to open, so that the amount of taken-in air flowing within the carburetor Cb is increased.

The steering throttle arm 33A and the propulsion throttle arm 33B respectively engage with the throttle operation shaft 33 to cause the throttle operation shaft 33 to rotate to open the throttle valve (clockwise in FIGS. 2 and 3). On the other hand, the steering throttle arm 33A and the propulsion throttle arm 33B respectively disengage from the throttle operation shaft 33 to cause the throttle operation shaft 33 to rotate to close the throttle valve (counterclockwise in FIGS. 2 and 3). That is, when the steering throttle arm 33A and the propulsion throttle arm 33B rotate to close the throttle valve, they rotate independently of the throttle operation shaft 33. The configuration for transmitting the rotation from the throttle arm 33A or 33B to the operation shaft 33 only in one direction is accomplished by using a ratchet mechanism. Further, the steering throttle arm 33A and the propulsion throttle arm 33B operate independently of each other so that an operation of one of the steering throttle arm 33A and the propulsion throttle arm 33B does not affect an operation of the other.

In this structure, upon the rider operating the throttle lever Lt in the vicinity of the steering handle 10, the propulsion throttle arm 33B connected to the throttle lever Lt through the wire 34 rotates to cause the throttle operation shaft 33 of the carburetor Cb to rotate, but the steering throttle arm 33A remains unmoved.

Conversely, when the steering throttle arm 33A is rotated by the actuator 31 to cause the throttle operation shaft 33 to rotate, another ratchet mechanism having a similar configuration allows the propulsion throttle arm 33B to remain unmoved.

In FIG. 2, reference numerals 51A and 51B denote air-intake pipes. It should be appreciated that in FIGS. 2 and 3, the positional relationship between the actuator 31 and the carburetor Cb is not illustrated correctly, but rotational relationship between the output shaft 31S and the steering throttle arm 33A, and connection between them through the wire 32, are illustrated.

As shown in FIGS. 7 and 8, the actuator 31 is secured to an inside of the deck D below a front end of the seat S through a mounting plate member 37 (see FIGS. 2 and 3) by means of bolts. The carburetor Cb is provided on the left side of the engine E.

Figure 4:
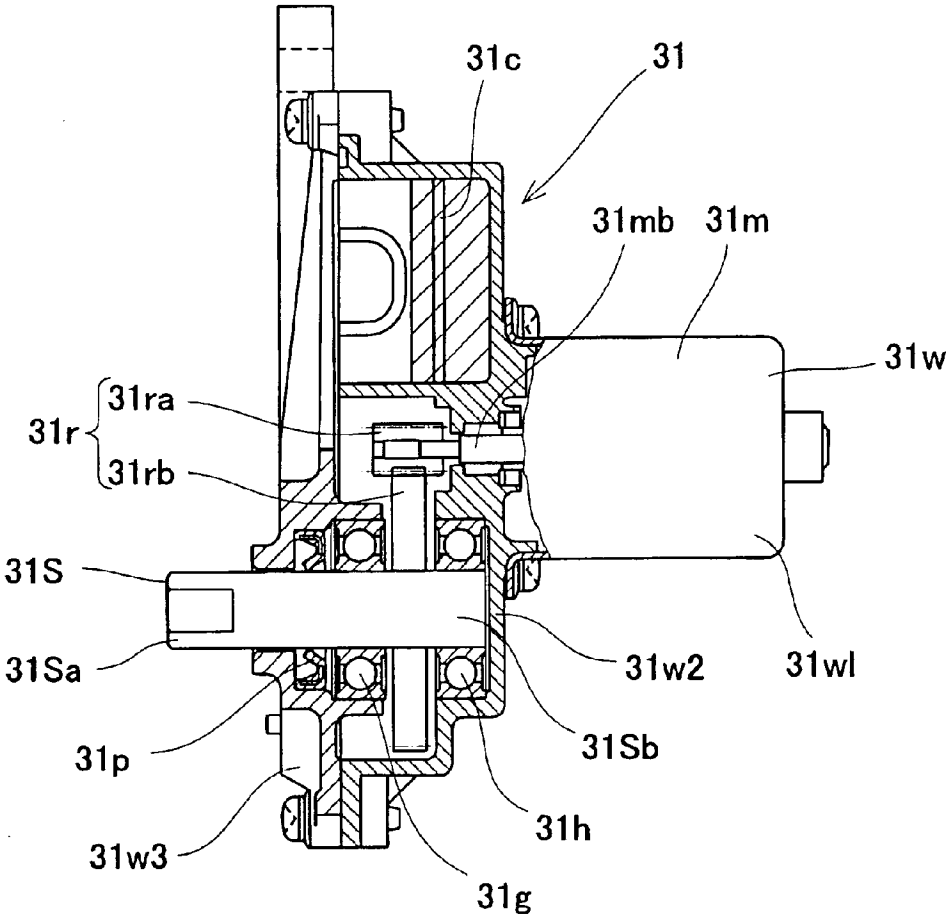
FIG. 4 is a cross-sectional view showing components in an internal structure of the actuator in FIGS. 1 to 3.

Referring to FIG. 4, a detailed structure of the actuator 31 will be described. The above actuator 31 comprises a motor (e.g., servo motor) 31*m*, the control board 31*c* configured to control energizing the motor 31*m* and its current value, a spur gear train 31*r* comprised of gears having different number of teeth as reduction gear means (device), the output shaft 31S for outputting rotation from the motor 31*m* to outside, and a water-proof cover 31*w* that covers these components.

The cover 31*w* is comprised of three parts, i.e., a motor casing portion 31*w*1, a concave base portion 31*w*2, and a lid portion 31*w*3. At joint portions of these portions, rubber packings are provided to function as seal.

A pinion gear (gear with smaller number of teeth) 31*ra* is attached on a rotational shaft 31*mb* of the motor 31*m* and a large gear (gear with larger number of teeth) 31*rb* is attached on the output shaft 31S to form a spur geat train 31*r*. Therefore, in this embodiment, the rotational shaft 31*mb* of the motor 31*m* and the output shaft 31S are arranged in parallel. The output shaft 31S is rotatably supported by two ball bearings 31*g* and 31*h* to reduce rotational resistance.

A base end portion 31S*b* of the output shaft 31S is accommodated within the cover 31*w*, and a tip end portion 31S*a* of the output shaft 31S is exposed outside so as to protrude from the lid portion 31W3 of the cover 31W. An oil seal 31*p* is provided outside the ball bearing 31*g* in the lid portion 31W3, to inhibit entry of water or the like.

The control board 31*c* is accommodated within the base portion 31*w*2 to be covered by resin (e.g., polyurethane resin) for waterproofing.

Figure 5:
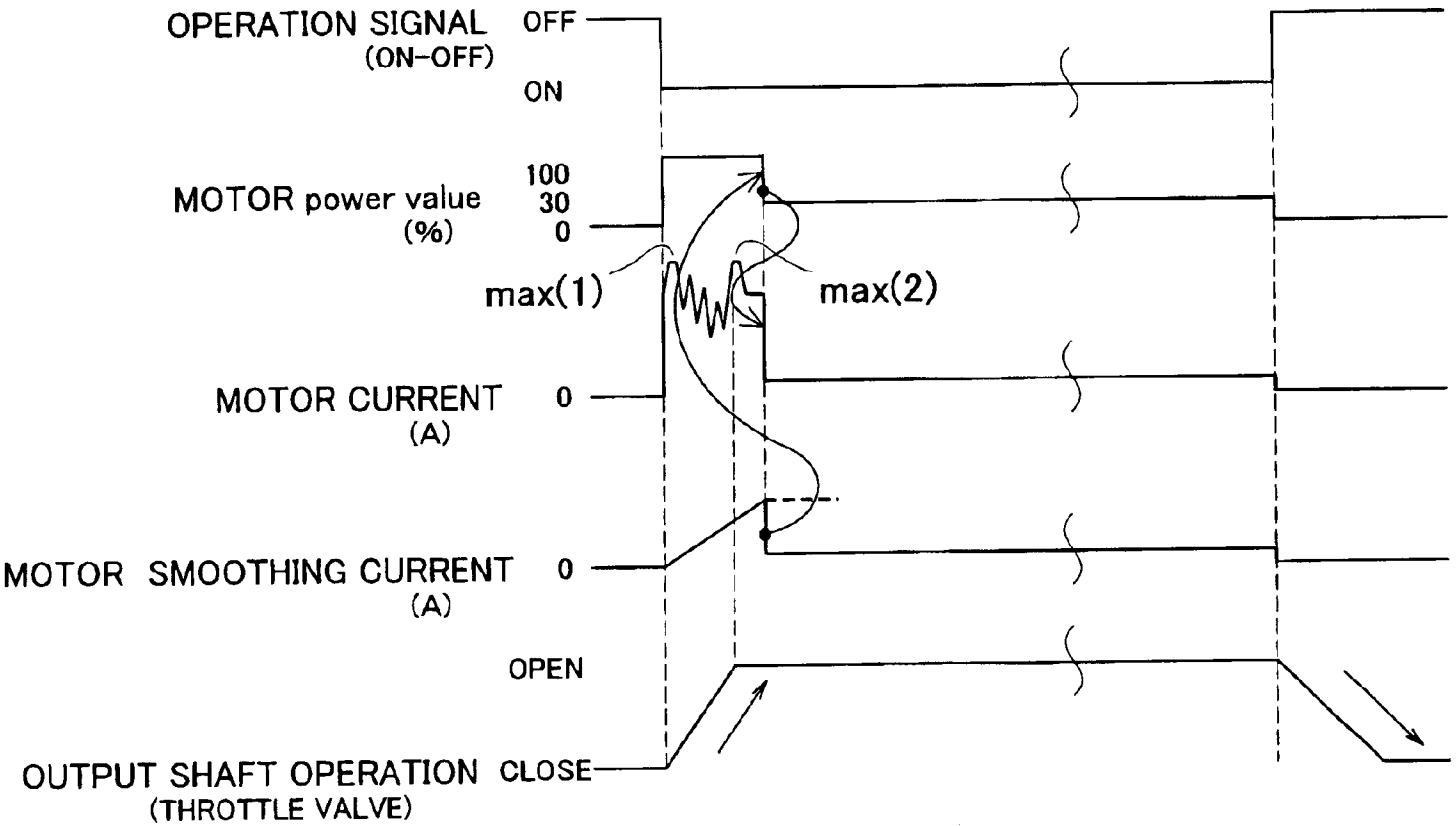
FIG. 5 is a timing chart showing control of a power of the actuator in FIGS. 1 to 4 and the operating state of the actuator, in which an abscissa axis represents a time axis.

Turning now to a timing chart in FIG. 5, the relationship between the control state of the power of the actuator and the operational state of the actuator is shown. In FIG. 5, "(A)" represents an ampere as a unit of a current value and an arrow in the form of a curved line represents the relationship among "motor power value", "motor current", and "motor smoothing current." The control board 31*c* is configured to control energizing the motor 31*m* (including the current value) in the manner as shown in FIG. 5. Specifically, as can be seen from an operation signal located on the uppermost side in FIG. 5, upon the operation signal from the electric control unit ECU being input to the control board 31*c*, the control board 31*c* executes control to allow the motor 31*m* to be energized at a power value (current value) of substantially 100%. As a result, as can be seen from "output shaft operation" in FIG. 5, the motor 31*m* operates at the power value of substantially 100% (the output shaft 31S rotates clockwise in FIG. 2). As can be seen from the "motor current" in FIG. 5, the current flowing within the motor 31*m* has a maximum value (max(1) in FIG. 5) at the activation of the motor 31*m*, and thereafter, decreases gradually with an elapse of time. Thereby, by the wire 32 with a base end connected to the rotational shaft of the motor 31*m*, the steering throttle arm 33A rotates clockwise in FIG. 2 to be brought into contact with the stopper 38.

Under this condition, as can be seen from the "motor current" in FIG. 5, the current value of the motor 31*m* rapidly increases to the maximum value (see max (2) in FIG. 5) again. When the current value becomes the maximum value in this manner, the control board 31*c* detects fluctuation (increase) in the current value and executes control so that the value of the current flowing within the motor 31*m* is reduced to substantially 30% (see "motor power value" in FIG. 5). Such an energized state continues until the operation signal from the electric control unit ECU to the control board 31*c* is stopped as shown in FIG. 5. Upon the operation signal from the electric control unit ECU to the control board 31*c* being stopped, that is, as soon as the operation signal is not output any more from the electric control unit ECU, the control board 31*c* stops energizing the motor 31*m*.

Thereby, a spring force of the helical torsion spring 9 for return causes the throttle operation shaft 33 and the steering throttle arm 33A of the carburetor Cb to return to their respective initial states (idling states). Correspondingly, the reel member 31R returns to its initial state.

Figure 6:
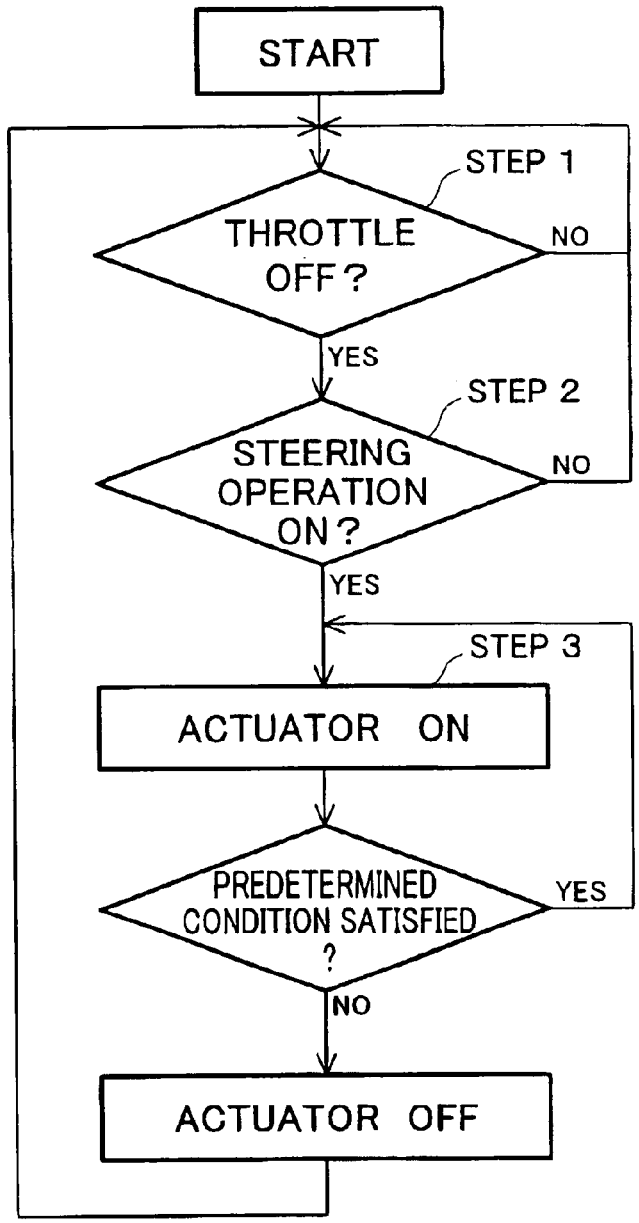
FIG. 6 is a flow chart showing a control process of a steering operation according to the embodiment of the present invention.

The actuator 31 and the small watercraft comprising the actuator 31 function as described below, during cruising. Hereinbelow, with reference to the flowchart in FIG. 6, this will be described.

Here, it is assumed that the rider operates the throttle lever Lt (see FIG. 8) to cause the throttle valve of the engine E to be closed, and thereby, the engine speed of the engine E decreases to an idling state. Under this condition, upon the rider operating the handle 10 a predetermined angle or more to the right or to the left, the throttle position sensor Ss and the steering position sensor Sp detect the corresponding operations (Steps 1 and 2) and send detection signals to the electric control units ECU. Upon detecting these signals, the electric control unit ECU sends the operation signal to the control board 31*c* of the actuator 31, and upon reception of the operation signal, the actuator 31 operates (Step 3). Specifically, the control board 31*c* starts energizing the motor 31*m* at the power value of substantially 100%. As a result, the steering throttle arm 33A rotates until it makes contact with the stopper 38.

As can be seen from FIG. 3, when the steering throttle arm 33A makes contact with the stopper 38, the control board 31*c* executes control so that the power value of the motor decreases from substantially 100% to substantially 30%, as can be seen from the "motor power value" in FIG. 5. Thereby, the steering throttle arm 33A continues the condition of contact with the stopper 38 and the engine E achieves an operating state at approximately 2000 rpm in this embodiment. Now, the small watercraft can be steered.

And, when the small watercraft arrives at a shore or pier, for example, and the rider turns OFF a switch of the engine E, energizing the electric control unit ECU and the actuator 31 are stopped. As a result, the motor 31*m* stops, and the spring force of the helical torsion spring 39 causes the throttle operation shaft 33 to return to cause the engine E to enter the idling state. The steering throttle arm 33A moves away from the stopper 38 and returns to its initial state (see the steering throttle arm 33A in FIG. 2). Thereby, by the spring force applied through the wire 32, the output shaft 31S of the actuator 31 returns to its initial state.

Upon the rider turning ON the switch of the engine E again, the engine E starts in the idling state. That is, it is not necessary to reset the actuator 31 so that the engine E re-starts in the idling state.

The water-proof actuator 31 can be placed within the engine room 20 without a sealed space for placing the actuator 31. In this state, installation of electric components such as the control board 31*c*, the motor 31*m*, etc, is not affected by water or the like.

Instead of using the actuator 31 for operating the throttle valve of the carburetor Cb, this actuator 31 may be used for operating another component, for example, a valve provided within an exhaust passage of the engine E. In an alternative configuration, the actuator 31 may be used for operating a valve within a leading passage for taking in ambient air into the engine room.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A jet-propulsion small watercraft, comprising:

a water jet pump that pressurizes and accelerates water taken in from outside and ejects the water from an outlet port provided behind the water jet pump to propel the watercraft as a reaction of the ejecting water;

a steering means configured to steer the watercraft by changing an ejection direction of the water ejected from the outlet port;

a throttle operation means configured to operate a throttle valve of an engine;

a steering throttle drive means configured to cause the throttle valve of the engine to open a predetermined angle under a predetermined condition, thereby maintaining a steering capability, in response to a closing operation of the throttle operation means;

an actuator configured to cause the throttle valve of the engine in a closed position to open a predetermined angle by the steering throttle drive means; and a spring configured to return the throttle valve of the engine to the closed position, wherein the actuator includes a motor configured to be energized at a predetermined current value by control of a control device, a reduction mechanism configured to reduce a speed of the motor, and an output shaft configured to be rotated at a reduced speed by the reduction mechanism, and when energizing the actuator is stopped by the control of the control device, the actuator permits the throttle valve of the engine to return to the closed position by a spring force of the spring.

2. The small watercraft according to claim 1, wherein the steering throttle drive means is a steering throttle arm attached on a throttle operation shaft of the engine, the steering throttle arm being configured to be rotatable integrally with the throttle operation shaft only in a direction to rotate for increasing an engine speed of the engine and not to be rotatable integrally with the throttle operation shaft in an opposite direction.

3. The small watercraft according to claim 2, wherein the throttle operation shaft is provided with a propulsion throttle arm capable of operating the throttle valve by an operation of the throttle operation means.

4. The small watercraft according to claim 3, wherein the propulsion throttle arm is attached on the throttle operation shaft to be rotatable integrally with the throttle operation shaft only in a direction to rotate for increasing the engine speed and not to be rotatable integrally with the throttle operation shaft in an opposite direction.

5. The small watercraft according to claim 4, wherein the steering throttle arm and the propulsion throttle arm are configured to operate the throttle operation shaft and operate independently of each other so that an operation of one of the steering throttle arm and the propulsion throttle arm does not affect an operation of the other.

6. The small watercraft according to claim 2, wherein a reel member is attached on the output shaft of the actuator to be rotatable integrally with the output shaft, an end of a wire is attached to the reel member, and an opposite end of the wire is attached to the steering throttle arm.

7. The small watercraft according to claim 1, wherein the motor is a servo motor, the small watercraft further comprising:

a stopper configured to stop the steering throttle drive means at a position where the throttle valve of the engine is opened the predetermined angle to inhibit further operation from the position, and the control device is configured to control a value of a power of the servo motor to reduce an output value of the servo motor, upon detecting variation in current being supplied to the servo motor when the steering throttle drive means makes contact with the stopper.

8. The small watercraft according to claim 7, wherein when the steering throttle drive means makes contact with the stopper, the control device is configured to execute control to cause the value of the power of the servo motor to be reduced to substantially 30% of the value of the power of the servo motor in a state in which the steering throttle drive means is not in contact with the stopper.

9. The small watercraft according to claim 1, wherein the reduction mechanism comprises a gear train comprised of pinion and large gears having different numbers of teeth, and the actuator is covered by a water-proof cover, wherein a shaft on which at least one of the gears is attached is supported by a bearing attached to the water-proof cover.

10. The small watercraft according to claim 1, wherein the spring is a helical torsion spring provided on a throttle operation shaft.

11. An actuator for use as a drive source of a movable portion of the small watercraft, comprising:

a motor for driving an output shaft of the actuator;

a reduction mechanism configured to reduce a speed from the motor and transmit the reduced speed toward the output shaft;

a control means configured to control a value of a power of the motor; and a water-proof cover configured to expose an output portion of the output shaft and cover at least the motor, the reduction mechanism, and part of the output shaft.

12. The actuator according to claim 11, wherein the motor is a servo motor, the actuator further comprising:

a stopper configured to stop the output shaft at a position where the output shaft rotates a predetermined angle so as to inhibit further rotation from the position, and the control device is configured to control a value of a power of the servo motor to reduce an output value of the servo motor, upon detecting variation in current being supplied to the servo motor when the output shaft makes contact with the stopper.

13. The actuator according to claim 11, wherein when the output shaft makes contact with the stopper, the control device is configured to execute control to cause the value of the power of the servo motor to be reduced to substantially 30% of the value of the power of the servo motor in a state in which the output shaft is not in contact with the stopper.

14. The actuator according to claim 11, wherein the reduction mechanism comprises a gear train comprised of pinion and large gears having different numbers of teeth, and a shaft on which at least one of the gears is attached is supported by a bearing attached to the water-proof cover.

* * * * *